US011345571B2

(12) United States Patent
Christen

(10) Patent No.: US 11,345,571 B2
(45) Date of Patent: May 31, 2022

(54) RACK-AND-PINION ELEVATOR SYSTEM HAVING A PROTECTIVE ROOF

(71) Applicant: Inventio AG, Hergiswil (CH)

(72) Inventor: Lukas Christen, Glattpark/Opfikon (CH)

(73) Assignee: INVENTIO AG, Hergiswil NW (CH)

( * ) Notice: Subject to any disclaimer, the term of this patent is extended or adjusted under 35 U.S.C. 154(b) by 557 days.

(21) Appl. No.: 16/310,596

(22) PCT Filed: Jun. 27, 2017

(86) PCT No.: PCT/EP2017/065918

§ 371 (c)(1),
(2) Date: Dec. 17, 2018

(87) PCT Pub. No.: WO2018/002093

PCT Pub. Date: Jan. 4, 2018

(65) Prior Publication Data

US 2019/0330022 A1 Oct. 31, 2019

(30) Foreign Application Priority Data

Jun. 30, 2016 (EP) ..... 16177327

(51) Int. Cl.
*B66B 11/00* (2006.01)
*B66B 7/02* (2006.01)
*B66B 9/00* (2006.01)

(52) U.S. Cl.
CPC ..... *B66B 11/0035* (2013.01); *B66B 7/023* (2013.01); *B66B 9/00* (2013.01)

(58) Field of Classification Search
CPC ..... B66B 11/0005; B66B 9/187; B66B 9/16; B66B 11/0045; B66B 19/005; B66B 7/023
See application file for complete search history.

(56) References Cited

U.S. PATENT DOCUMENTS 6,047,792 A * 4/2000 Jin ..... B66B 11/0226 187/401
7,635,049 B2 * 12/2009 Van Der Meijden ..... B66B 19/002 187/401
2011/0296772 A1 * 12/2011 Ericson ..... B66B 13/30 52/173.1

FOREIGN PATENT DOCUMENTS

CN 103025640 A 4/2013
CN 103303771 A 9/2013
FR 2694279 A1 * 2/1994
FR 3007008 A1 12/2014
WO 2013170439 A1 11/2013
(Continued)

OTHER PUBLICATIONS

Machine Translation of FR 2694279.*

*Primary Examiner* — Diem M Tran
(74) *Attorney, Agent, or Firm* — William J. Clemens; Shumaker, Loop & Kendrick, LLP

(57) ABSTRACT

An elevator system includes a lifting platform for securing at a plurality of securing positions in an elevator shaft and at least one guide rail for vertically guiding an elevator car in the elevator shaft. The lifting platform has a protective roof that protects the lifting platform against falling objects, wherein the protective roof has a rail opening, through which the guide rail extends, and wherein the protective roof has a cover covering the rail opening, the cover having a cover opening through which the guide rail extends.

16 Claims, 3 Drawing Sheets

(56) References Cited

FOREIGN PATENT DOCUMENTS

WO 2015003964 A1 1/2015

* cited by examiner

7 COUNTERWEIGHT
13 FASTENING POINTS
15 DRIVE MACHINE
45 RAIL CLAMP

RACK-AND-PINION ELEVATOR SYSTEM HAVING A PROTECTIVE ROOF

FIELD

The present invention relates to an elevator system, in particular in the form of a rack-and-pinion elevator system, having a specially designed protective roof.

BACKGROUND

Elevator systems are generally used to be able to transport people or objects in a usually vertical direction within existing buildings. For this purpose, an elevator car is moved within an elevator shaft by means of a suspension means such as one or more cables or belts.

Before the elevator system is operated in its normal operating mode, it can potentially already be installed in a building during a construction phase during which the building is not yet finished. It is then possible for the elevator system to already be used during the construction phase for the transport of people and/or materials, and for it to grow during the construction of the building. In so doing, during the construction phase it is possible to dispense with special external elevators, for example, that would be attached for example to an outer face of the building.

For this purpose, for example, some guide rails and an elevator car can already be mounted in the elevator shaft provided for the elevator system at a point in time at which only one or more lower floors of the building have been finished. The elevator car and further components of the elevator system, such as a counterweight, can in this case typically be hung on a lifting platform by means of the suspension means. A drive machine can be provided on the lifting platform, which machine can move the suspension means for example by means of a traction sheave. The lifting platform can be raised to a next higher level for example using a crane or other means in order to lengthen the transport path of the elevator system.

For example, in a rack-and-pinion elevator system, the guide rails and/or holding rails of the elevator system that are provided for guiding the lifting platform are successively installed in the elevator shaft during the construction phase of the building and the lifting platform is transported upwards on the guide rails or holding rails when required. The lifting platform can then be fixed at a desired higher position for example using braces, which can for example be pushed out of the lifting platform into openings in the walls of the elevator shaft.

WO 2015/003964 A1 discloses an example of a rack-and-pinion elevator system.

There can be a risk, in particular for an elevator system installed during the construction phase of a building, of components of the elevator system being damaged by dirt or falling objects. People inside the elevator shaft, for example maintenance staff, could also be injured, for example by falling objects.

There may therefore be a need, inter alia, for an elevator system in which the components of the elevator system and/or people in the elevator shaft are efficiently protected against falling objects or dirt.

SUMMARY

Possible features and advantages of embodiments of the invention may be considered, inter alia and without limiting the invention, to be dependent upon the concepts and findings described below.

The present invention relates to an elevator system comprising a lifting platform and a protective roof for the lifting platform. An elevator system can comprise an elevator car and suspension means, wherein the elevator car is held by the suspension means and can be moved inside the elevator shaft along at least one guide rail by means of the suspension means. The suspension means can be held on the lifting platform. Furthermore, the protective roof can be arranged above components of the lifting platform to be protected, such as a drive machine. People and/or objects can be transported using the elevator car.

The lifting platform can be designed to fasten to a plurality of fastening positions in the elevator shaft. The lifting platform can be designed to hold the weight of the elevator car by means of the suspension means held on said platform and optionally to hold the weight of a counterweight which is likewise fastened to the suspension means. The suspension means should also be held on the lifting platform such that they can be moved and the elevator car held on the suspension means can therefore likewise be moved. A drive machine can optionally be arranged on the lifting platform for this purpose, which machine is used to drive the suspension means. The drive machine can, for example, drive a traction sheave in rotation, and the suspension means can be placed around the traction sheave in order to be moved thereby. Alternatively, only deflection rollers can be provided on the lifting platform, around which rollers the suspension means is wound, and a drive machine can be arranged at another position inside the elevator shaft or inside a machine room in order to be able to move the suspension means. Other configurations can also be used in which the suspension means is rigidly held on the lifting platform or held on the lifting platform so as to be movable relative thereto.

The lifting platform can also have a protective roof which is designed to protect the lifting platform against falling objects. The protective roof can be fastened over the lifting platform and/or to the lifting platform. The protective roof is provided, inter alia, to protect components of the lifting platform that are located underneath the protective roof in particular against objects falling from above and possibly also dirt or water. People underneath the protective roof in the elevator shaft are also intended to be protected.

This can then be particularly advantageous when the elevator system together with the lifting platform thereof is designed to be temporarily fastened to various positions within the elevator shaft, i.e. when the elevator system is designed as a rack-and-pinion elevator system to already be installed in a building during a construction phase and/or to be able to grow with the building during this construction phase by successively moving the lifting platform. The elevator shaft in the building is typically still open at the top during a construction phase of this kind. Moreover, the lifting platform is typically not arranged at a highest point of the building or at least of the elevator shaft, as is usually the case in finished buildings. As a result there can be an increased risk of objects that come from higher up in the building, such as screws or tools, accidentally falling into the elevator shaft and thus damaging or injuring components of the elevator system located therein, in particular of the lifting platform or a drive machine possibly arranged there, and people. Sensitive components of the lifting platform or of the drive machine can also be damaged by dirt or water, for example rain, coming from above.

According to one embodiment of the invention, the elevator system has at least one guide rail for vertically guiding the elevator car in the elevator shaft, wherein the protective roof has a rail opening through which the guide rail extends and wherein the protective roof has a cover for covering the rail opening, which cover has a cover opening through which the guide rail extends. The elevator car is usually guided in the elevator shaft by a plurality of guide rails. These guide rails are usually fastened to lateral walls of the elevator shaft and/or can also be installed above the lifting platform. When the lifting platform is repositioned in the elevator shaft, the lifting platform has to be moved along the guide rails; for this purpose, rail openings are present which can also be sufficiently large that components fastened to the guide rails, such as rail clamps for fastening the guide rails, can be moved through the lifting platform and in particular the protective roof.

In order to make the protective roof even more effective, the rail openings can each be covered by a cover when the lifting platform has arrived at the next fastening position thereof and/or the elevator system is put into operation. The cover can cover the rail opening except for a gap between the guide rail and an edge of the cover opening. This can therefore prevent objects from falling down through the rail opening.

According to one embodiment of the invention, the cover opening has a shape which corresponds to a cross section of the guide rail. For example, a gap between an edge of the cover opening and the guide rail can be substantially the same width.

According to one embodiment of the invention, the cover opening and a cross section of the guide rail are T-shaped. Guide rails often have a T-profile. In this case, the cover opening can also be T-shaped.

According to one embodiment of the invention, the cover opening is formed such that a gap having a maximum width of 30 mm, for example maximum 10 mm, is present between the cover and the guide rail.

According to one embodiment of the invention, the cover is formed of at least two cover parts. The two cover parts can be positioned on the side of the guide rail in order to form the cover opening. The two cover parts can contact one another or overlap along one edge.

According to one embodiment of the invention, the cover opening is provided by only one cover part. It is possible for the one cover part to be substantially rectangular, whereas the other cover part has a recess on one edge, which recess can have a shape corresponding to the guide rail.

According to one embodiment of the invention, the cover opening is provided by two of the cover parts. It is also possible for two cover parts to have recesses on opposing edges, which recesses can together have a shape corresponding to the guide rail.

According to one embodiment of the elevator system, a cross section of the rail clamp is arranged completely within the cross section of the rail opening, wherein the guide rail can be fastened to a lateral wall of the elevator shaft by means of the rail clamp. In so doing, the lifting platform comprising the protective roof can be moved past the rail clamp, without any collisions occurring between the rail clamp and the central roof construction, when the cover is opened above the rail opening. The guide rail can thus be lengthened beyond the lifting platform even before the lifting platform is moved.

According to one embodiment of the invention, the cover is fastened to the protective roof by means of hinges. Alternatively, it is also possible for the cover to merely be placed on the rail opening. If the cover and in particular the cover parts are fastened to the protective roof by means of hinges, in so doing a closed position of the cover can be defined and/or the cover and/or the cover parts cannot be lost.

According to one embodiment of the invention, the cover is arranged on an edge of the protective roof. In this case, the cover or cover parts of the cover can be pivoted upwards about a hinge axis in parallel with the edge and/or orthogonally with respect to the edge. It is possible for a cover part to be pivoted or moved towards a lateral wall and/or for another cover part to be pivoted or moved away from the lateral wall on which the cover or the rail opening is arranged. Alternatively, the two cover parts can be pivoted or moved about an axis substantially orthogonally with respect to the sides.

According to one embodiment of the invention, the cover is placed on a cover box which is fastened on the protective roof. The cover box can, for example, have a plurality of lateral walls, the lower edge of which are fastened to the protective roof and on the upper edge of which the cover is placed. If the cover is fastened to the protective roof by means of hinges, these hinges can be fastened to the cover box and in particular to the lateral walls thereof.

According to one embodiment of the invention, the cover box extends as far as an edge of the protective roof. It is possible for an edge of the cover box to provide an edge of the protective roof.

According to one embodiment of the invention, the protective roof comprises a central roof construction which extends horizontally. The cover can be arranged at least in part over the central roof construction.

The central roof construction can in this case be arranged above and cover the central regions of the lifting platform. In particular, the central roof construction can be designed and dimensioned such that it does not, for example, need to be disassembled when the lifting platform is intended to be moved within the elevator shaft. For example, the central roof construction can be dimensioned such that the edges thereof are sufficiently spaced apart from the lateral walls of the elevator shaft, i.e. for example by at least 10 cm, preferably by at least 30 cm. The central roof construction can, for example, be a plate made of a sufficiently stable material, for example a metal plate. It can also be composed of a plurality of plates.

The central roof construction can have a rail opening for each guide rail, through which opening the guide rail extends. The cover box can be arranged around this rail opening, which cover box carries the cover in order to cover the rail opening.

According to one embodiment of the invention, the protective roof has a peripheral flank construction that extends diagonally with respect to a horizontal line. This flank construction can have flank walls which protrude diagonally upwards from the central roof construction. The cover can be arranged at least in part over the peripheral flank construction or between sub-elements of a flank wall of the flank construction.

Regions having a peripheral flank construction can in each case be adjacently connected to the lateral edges of the central roof construction. The peripheral flank construction is therefore predominantly arranged in regions between the central roof construction and surrounding lateral walls of the elevator shaft.

The flank construction of the protective roof can have flank walls which are fastened to the lateral edges of the central roof construction. These flank walls protrude outwards from the central roof construction, i.e. towards an adjacent wall of the elevator shaft in each case. However, in this case the flank walls are not oriented horizontally, but instead extend at an inclined angle with respect to the horizontal line. The flank walls arranged at an inclination can form a funnel such that objects falling from above onto the lateral walls are deflected towards the central roof construction and can be collected there.

The flank walls and/or the cover box can be fastened to the central roof construction in a position and orientation in which the edge regions or edges of the flank walls and/or of the cover box are spaced apart from the lateral walls of the elevator shaft by less than 30 mm, preferably less than 10 mm.

It is possible for the flank construction and optionally the cover boxes to be released from the central roof construction when the lifting platform is intended to be moved in the elevator shaft.

According to one embodiment of the invention, the cover box on which the cover is placed is fastened on the central roof construction. The peripheral flank construction that extends diagonally with respect to a horizontal line can be fastened to the side of the cover box. As a result, the cover box can also extend as far as the edge of the protective roof. In so doing, the cover box can interrupt or complete the flank construction in the region of a guide rail.

According to one embodiment of the invention, the cover, the cover box, the lateral walls thereof and/or the flank walls consist of metal or a composite material provided with a metal layer. However, these components can also consist of any sufficiently mechanically stable material, such as plastics, plastics composite materials, wood, wood composite materials or the like. However, it is considered to be advantageous for these components to be formed of metal or at least have a metal layer, since this results in sufficient mechanical strength and can also achieve simple manufacturing at low production and material costs.

Embodiments of the invention will be described below with reference to the accompanying drawings, neither the drawings nor the description being intended to be interpreted as limiting the invention.

The drawings are merely schematic and not true to scale. Like reference signs refer in the different drawings to like or analogous features.

DETAILED DESCRIPTION

Figure 1:
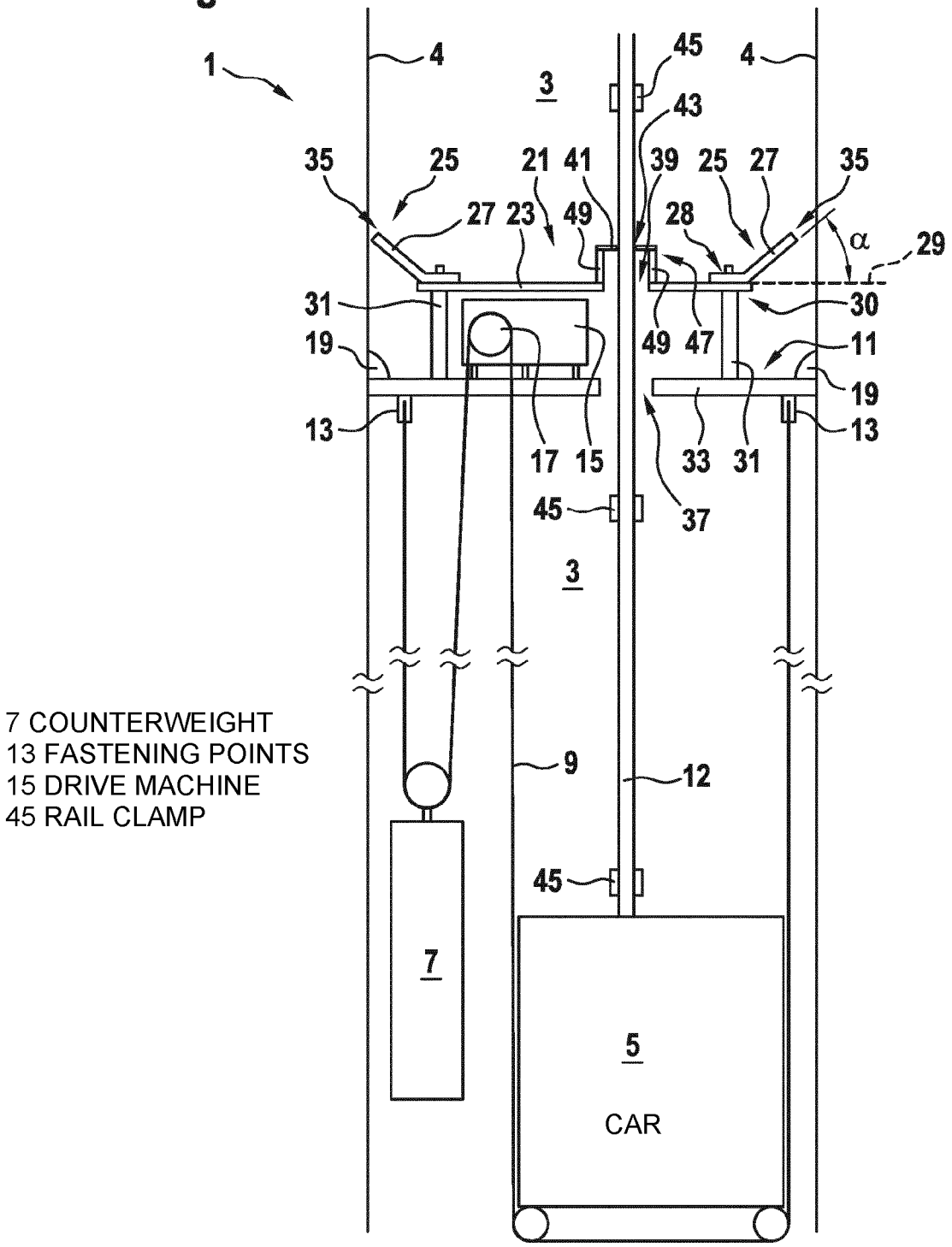
FIG. 1 is a side sectional view through an elevator system according to an embodiment of the invention.

FIG. 1 shows an elevator system 1 in the form of a rack-and-pinion elevator system. The elevator system 1 comprises an elevator shaft 3 in which an elevator car 5 and a counterweight 7 are housed. The elevator car 5 and the counterweight 7 are held on a lifting platform 11 by means of a suspension means 9. The suspension means 9 typically comprises a plurality of cables or belts. The elevator system 1 also comprises guide rails 12 on which the elevator car 5 is vertically guided in the elevator shaft.

The lifting platform 11 is at least temporarily rigidly fastened in the elevator shaft 3. Fastening points 13 are attached to the lifting platform 11, on which points ends of the suspension means 9 are rigidly held. A drive machine 15 is also provided on the lifting platform 11. This drive machine 15 drives a traction sheave 17 in rotation. The suspension means 9 is wound around the traction sheave 17 and can thus be moved by the rotating traction sheave 17, as a result of which the elevator car 5, guided on the guide rails 12, and the counterweight 7 can be moved within the elevator shaft 3 in opposite directions.

The elevator system 1 is designed to already be installed in a building during a construction phase. This means that the elevator system 1 can already be operated when the building in which it is housed is only partially finished. After particular construction progress has been made, the lifting platform 11 can be moved upwards within the elevator shaft 3 and therefore the elevator system 1 can "grow with" the building. In order to move the lifting platform 11, anchors 19 (only shown schematically) can in this case be temporarily released, the lifting platform 11 is then lifted upwards for example by means of a crane and the suspension means 9 is optionally suitably lengthened, and subsequently the lifting platform 11 is again anchored at the new fastening position thereof in the elevator shaft 3.

In order to protect the components of the lifting platform 11 or the assemblies mounted thereon, such as the drive machine 15, against objects falling through the elevator shaft 3, a protective roof 21 is provided above components of this kind to be protected, which roof is intended to act as a crash deck. In the example shown, the protective roof 21 is supported on a support plate 33 of the lifting platform 11 by means of supports 31 and, above the components to be protected, spans wide parts of the cross-sectional area of the elevator shaft 3. In this case, the protective roof 21 is designed, owing to the geometric design thereof as well as owing to the choice of material for the components thereof, such that it has sufficient stability to be able to protect the components underneath that are intended to be protected against objects falling from above, such as typically screws, tools, small stones etc.

Figure 2:
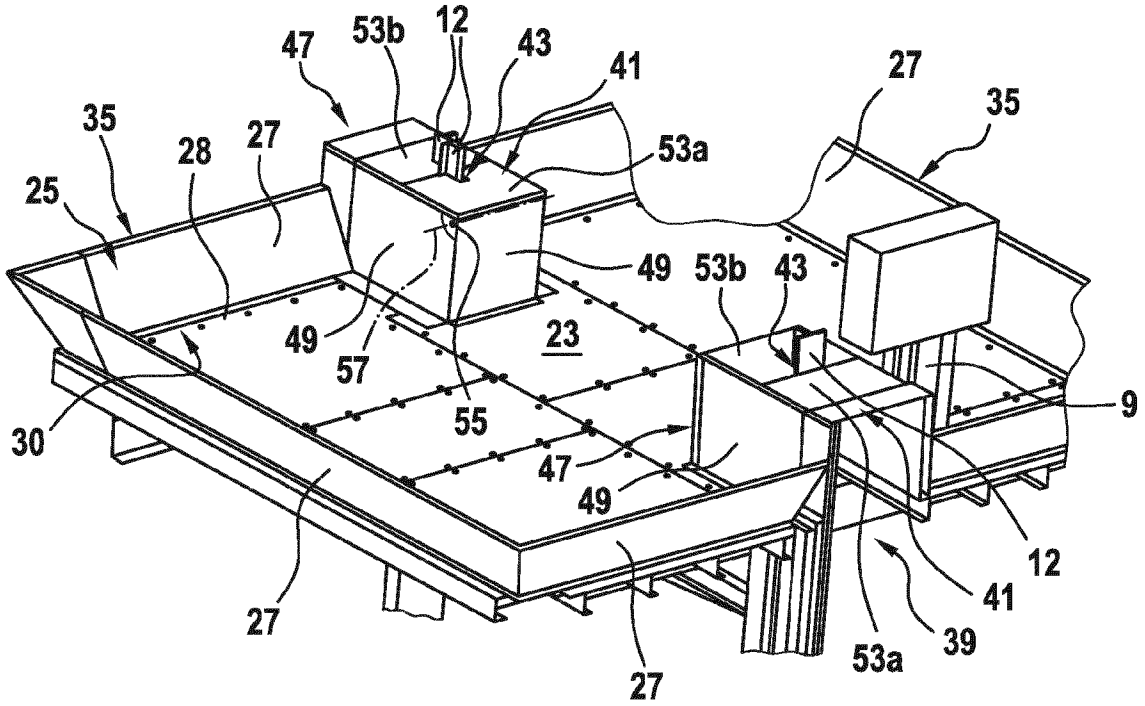
FIG. 2 is a perspective view from above of a protective roof of an elevator system according to an embodiment of the invention.

As can also be seen in FIG. 2, the protective roof 21 has a central roof construction 23. The central roof construction 23 is preferably planar and can consist of one or more plates put together, for example metal plates or metal composite plates or even sufficiently thick wood plates.

A flank construction 25 is provided so as to adjoin lateral edges 30 of the roof construction 23. The flank construction 25 has flank walls 27 which are fastened, in the lower end regions 28 thereof, to lateral edges 30 of the roof construction 23 and which project from there diagonally upwards and outwards in an inclined manner with respect to the horizontal line 29 (see FIG. 1). At the upper end regions thereof, the flank walls 27 form an outer edge 35 of the protective roof 21.

As is shown in FIG. 1, the flank walls 27 are arranged at an angle $\alpha$ of typically between 40° and 50° with respect to the horizontal line 29. The flank walls 27 extend as far as or at least to just in front of an adjacent lateral wall 4 of the elevator shaft 3 and therefore close a gap which would otherwise be present between the central roof construction 23 and the lateral wall 4.

Each of or at least some of the guide rails 12 extend through a rail opening 37 in the support plate 33 of the lifting platform 11 and through a rail opening 39 in the central roof construction 23. The rail opening 39 is in this case closed by a cover 41 which in turn has a cover opening 43 that is significantly smaller than the rail opening 39. The cover 41 therefore protects the components of the elevator system 1 that are under the protective roof 21 against falling objects, since the rail opening 39 is almost completely closed by the cover 41.

The cover 41 can be produced from one or more substantially planar metal plates.

The rail openings 37, 39 are sufficiently wide that a rail clamp 45, by means of which the associated guide rail 12 is secured to a wall 4 of the elevator system 1, can be guided through said openings when moving the lifting platform 11. Therefore, in order to move the lifting platform 11, only the cover 41 that is for example placed on the rail opening 39 has to be removed.

A cover box 47 can be fastened on the protective roof 21 or the central roof construction 23, which box can have a plurality of perpendicular lateral walls 49 and surrounds the rail openings 39. The cover 41 can also be designed as a cover for the cover box 47 and/or be placed on the upper end thereof.

FIG. 2 is a perspective view of a plurality of cover boxes 47 and a plurality of covers 41. Each of the cover boxes 47 extends as far as the edge 35 of the protective roof 21, the face of the cover box 47 that faces the associated wall 4 being open. Moreover, each of the cover boxes 47 is fastened on the central roof construction 23 that extends horizontally. The peripheral flank construction 25 that extends diagonally with respect to the horizontal line is fastened to the side of the relevant cover box 47 by means of the flank walls 27.

As can be seen in FIG. 2, the guide rails 12 have a T-shaped cross section. A corresponding shape of the cover openings 43 is also T-shaped. Each of the cover openings 43 is formed such that just a narrow gap remains between the corresponding guide rail 12 and the edge of the cover openings 43, which gap has a maximum width of less than 30 mm, such as approximately 10 mm, for example. It is possible for a cover to have a plurality of cover openings 43, or for a plurality of guide rails 12 to extend through a rail opening 37, 39.

A cover 41 can be divided into two or more cover parts 53*a*, 53*b*, between which (aside from the cover openings 43) only one slot (for example narrower than 10 mm) is formed when the cover 41 is located on the rail opening 39. Alternatively, these cover parts 53*a*, 53*b* can overlap.

For example, the or a cover opening 43 is designed so as to be completely within a cover part 53*a*, the other cover part 53*b* providing only one edge of the cover opening 43.

Figure 3:
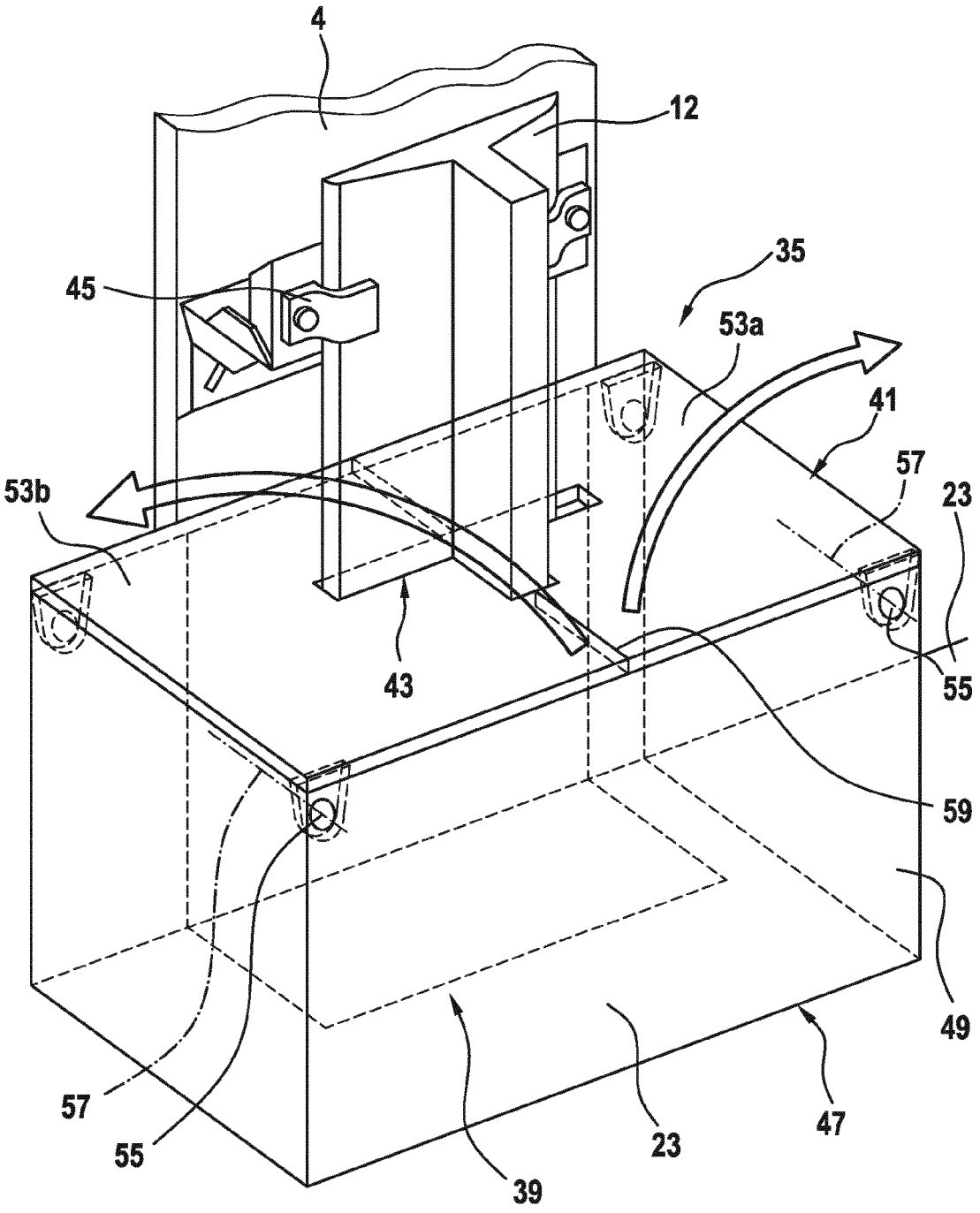
FIG. 3 is a perspective view of a cover box for an elevator system according to an embodiment of the invention.

As can be seen from FIG. 3, it is also possible for the cover opening 43 to be formed by two cover parts 53*a*, 53*b*. FIG. 3 also shows that each of the cover parts 53*a*, 53*b* can be connected to the cover box 47 by means of a hinge 55. In FIG. 3, the hinges 55 are arranged such that the hinge axis 57 extends substantially orthogonally with respect to the wall 4 or to the edge 35 of the protective roof 21, next to which the cover 41 is arranged. The slot 59 dividing the cover parts 53*a*, 53*b* also extends substantially orthogonally with respect to the wall 4 or to the edge 35 of the protective roof 21. The cover parts 53*a*, 53*b* can thus fold outwards along the wall 4 or the edge 35, as indicated by the arrows.

Conversely, FIG. 2 shows that the slot 59 dividing the cover parts 53*a*, 53*b* can extend substantially in parallel with the wall 4 or the edge 35. Also in FIG. 2, it is possible for the cover parts 53*a*, 53*b* to be connected to the cover box 47 by means of hinges 55, it being possible in this case for the hinge axis 57 to extend substantially in parallel with the wall 4 or the edge 35.

It can also be seen in FIG. 3 that the rail clamp 45 protrudes from the wall 4 and clasps a base of the guide rail 12. For this reason, the rail opening 39 that is formed as a rectangular opening in the central roof construction 23 is located on the edge of the central roof construction 23.

In conclusion, it should be noted that terms like "having," "comprising", etc. do not exclude any other elements or steps, and terms like "a" or "an" do not exclude a plurality. Furthermore, it is noted that features or steps that have been described with reference to one of the aforementioned embodiments may also be used in combination with other features or steps of other embodiments described above. Reference signs in the claims should not be considered limiting.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system comprising:

a lifting platform adapted to be fastened to each of a plurality of fastening positions in an elevator shaft;

at least one guide rail for vertically guiding an elevator car in the elevator shaft, wherein the guide rail is fastened to a lateral wall of the elevator shaft by a rail clamp;

a protective roof arranged above the lifting platform that protects the lifting platform against falling objects in the elevator shaft, wherein the protective roof has a rail opening through which the guide rail extends, wherein a cross section of the rail clamp can be guided through the cross section of the rail opening; and a cover arranged above and mounted on the protective roof and covering the rail opening, the cover having a cover opening through which the guide rail extends.

2. The elevator system according to claim 1 wherein the cover opening has a shape that corresponds to a cross section of the guide rail.

3. The elevator system according to claim 1 wherein the cover opening and a cross section of the guide rail are T-shaped.

4. The elevator system according to claim 1 wherein a gap having a maximum width of 30 mm is present between the cover opening and the guide rail extending through the cover opening.

5. The elevator system according to claim 1 wherein the cover is formed of at least two cover parts.

6. The elevator system according to claim 5 wherein the cover opening is formed in only one of the at least two cover parts, or wherein the cover opening is formed in two of the at least two cover parts.

7. The elevator system according to claim 1 wherein the cover is connected to the protective roof by hinges.

8. The elevator system according to claim 1 wherein the cover is arranged on an edge of the protective roof and the cover or cover parts of the cover are pivotable upwards about a hinge axis at least one of in parallel with the edge and orthogonally with respect to the edge.

9. The elevator system according to claim 1 wherein the protective roof includes a central roof construction that extends horizontally, and wherein the cover is arranged at least in part over the central roof construction.

10. The elevator system according to claim 1 wherein the protective roof has a peripheral flank construction that extends diagonally with respect to a horizontal line, and wherein the cover is arranged at least in part over the peripheral flank construction.

11. The elevator system according to claim 1 wherein the cover is positioned on a cover box that is fastened on the protective roof.

12. The elevator system according to claim 11 wherein the cover box extends to an edge of the protective roof.

13. The elevator system according to claim 11 wherein the cover box is fastened on a central roof construction of the protective roof that extends horizontally, and a peripheral flank construction of the protective roof that extends diagonally with respect to a horizontal line is fastened to a side of the cover box.

14. The elevator system according to claim 1 further comprising:

the elevator car; and a suspension means wherein the elevator car is held by the suspension means and can be moved inside the elevator shaft along the at least one guide rail by the suspension means, wherein the suspension means is held on the lifting platform, and wherein the protective roof is arranged above components of the lifting platform to be protected.

15. An elevator system comprising:

a lifting platform adapted to be fastened to each of a plurality of fastening positions in an elevator shaft;

at least one guide rail for vertically guiding an elevator car in the elevator shaft, wherein the guide rail is fastened to a lateral wall of the elevator shaft by a rail clamp;

wherein the lifting platform has a protective roof that protects the lifting platform against falling objects in the elevator shaft;

wherein the protective roof has a rail opening through which the guide rail extends, wherein a cross section of the rail clamp can be guided through the cross section of the rail opening; and wherein the protective roof has a cover arranged on the protective roof and covering the rail opening, the cover having a cover opening through which the guide rail extends, where the cover is connected to the protective roof by hinges.

16. An elevator system comprising:

a lifting platform adapted to be fastened to each of a plurality of fastening positions in an elevator shaft;

at least one guide rail for vertically guiding an elevator car in the elevator shaft, wherein the guide rail is fastened to a lateral wall of the elevator shaft by a rail clamp;

wherein the lifting platform has a protective roof that protects the lifting platform against falling objects in the elevator shaft;

wherein the protective roof has a rail opening through which the guide rail extends, wherein a cross section of the rail clamp can be guided through the cross section of the rail opening; and wherein the protective roof has a cover arranged on the protective roof and covering the rail opening, the cover having a cover opening through which the guide rail extends, where the cover is positioned on a cover box that is fastened on the protective roof.

* * * * *